US007448927B2

(12) United States Patent
Brown et al.

(10) Patent No.: US 7,448,927 B2
(45) Date of Patent: Nov. 11, 2008

(54) SHALLOW DRAFT BOAT WITH A TRI-TUNNEL HULL

(75) Inventors: Ralph Brown, Spring Hill, FL (US); Marin Savov, Hudson, FL (US)

(73) Assignee: Ralph D. Brown, Spring Hill, FL (US)

( * ) Notice: Subject to any disclaimer, the term of this patent is extended or adjusted under 35 U.S.C. 154(b) by 792 days.

(21) Appl. No.: 10/889,624

(22) Filed: Jul. 12, 2004

(65) Prior Publication Data

US 2005/0005836 A1 Jan. 13, 2005

Related U.S. Application Data

(60) Provisional application No. 60/486,712, filed on Jul. 12, 2003.

(51) Int. Cl.
*B63B 1/32* (2006.01)
*B63H 5/16* (2006.01)

(52) U.S. Cl. ..... 440/69; 114/290

(58) Field of Classification Search ..... 114/288, 114/289, 290; 440/66, 69
See application file for complete search history.

(56) References Cited

U.S. PATENT DOCUMENTS

| | | | | | |
|---|---|---|---|---|---|
| 1,710,904 | A | * | 4/1929 | Titcomb | 114/288 |
| 2,020,792 | A | * | 11/1935 | Maynard et al. | 114/290 |
| 2,083,959 | A | * | 6/1937 | McMullen | 440/48 |
| 2,234,899 | A | * | 3/1941 | Higgins | 114/290 |
| 3,515,087 | A | * | 6/1970 | Stuart | 114/286 |
| 3,626,894 | A | * | 12/1971 | Stuart | 440/69 |
| 3,744,446 | A | * | 7/1973 | Gibbins | 440/69 |
| 4,091,761 | A | * | 5/1978 | Fehn | 114/290 |

* cited by examiner

*Primary Examiner*—Sherman Basinger

(57) ABSTRACT

A shallow draft boat has a hull that protects a propulsion propeller within a tunnel that passes only partially through the hull from stem to bow. The hull causes mixing of water and air at high pressure during motion of the boat through the water, creating lift and a pressure gradient that keeps the tunnel filled. The boat prevents propulsion unit malfunction by keeping obstacles, such as debris, crab pots and mammals such as manatees from contact with the propeller.

10 Claims, 5 Drawing Sheets

SHALLOW DRAFT BOAT WITH A TRI-TUNNEL HULL

CROSS REFERENCE TO RELATED APPLICATIONS

This application incorporates by reference in its entirety and claims priority to U.S. Provisional Application 60/486,712, filed Jul. 12, 2003, entitled Tri-Tunnel by inventor Ralph Brown.

BACKGROUND OF THE INVENTION

1. Field of the Invention

The invention is directed to powerboat techniques, and, more particularly to a powerboat with a tri-tunnel design.

2. Description of Related Art

A wide variety of boat constructions are well known in the art. For example, catamaran and trimaran sailboats are well known. Similarly, a significant number of powerboat constructions are well known in the art.

A number of problems exist with respect to powerboats of the prior art. First, they often experience difficulty when running in very shallow water. For example, the propeller, which drives the boat, may encounter the bottom of the waterway and bend the propeller or sheer a pin connecting the propeller to the drive shaft.

Another problem comes from obstacles such as crab pots. The cable that connects the floater with the crab pot can become entangled in the propeller causing the engine to stop and causing the boat operator great difficulty freeing the propeller from the cable.

A similar problem comes from encountering floating debris on the surface of the water. Often, debris floats in such a way that it is not easily visible from the boat. When a powerboat passes over such debris, such as a floating log, the debris may impact the propeller and bend it or sheer the drive pin.

Serious problems exist in certain waters caused by the presence of large, slow moving mammals such as manatees. The survival of the manatees is and has been threatened by increased boating traffic. The manatees are often found near the surface and cannot move quickly enough to avoid powerboats, resulting in propeller cuts and other injuries to the mammals.

BRIEF SUMMARY OF THE INVENTION

The invention is directed to a powerboat with a hull design that avoids the problems of the prior art. More specifically, the hull design permits very shallow draft, a stable ride, protection from obstacles and debris and provides safety to manatees and other large mammals.

This is achieved, in accordance with the invention, by providing two tunnels in the hull design, which allow water to flow completely from bow to stem through those tunnels. The tunnels are arranged in such a way as to create a relatively high pressure, as the boat is propelled through the water, providing lift and creating a pressure gradient which allows water to flow under influence of the high pressure from the tunnels to an adjacent partial tunnel in which the drive shaft and propeller of the boat are located.

BRIEF DESCRIPTION OF THE DRAWINGS

The invention will be described more particularly with reference to the following drawings, in which.

DETAILED DESCRIPTION OF THE INVENTION

Figure 1:
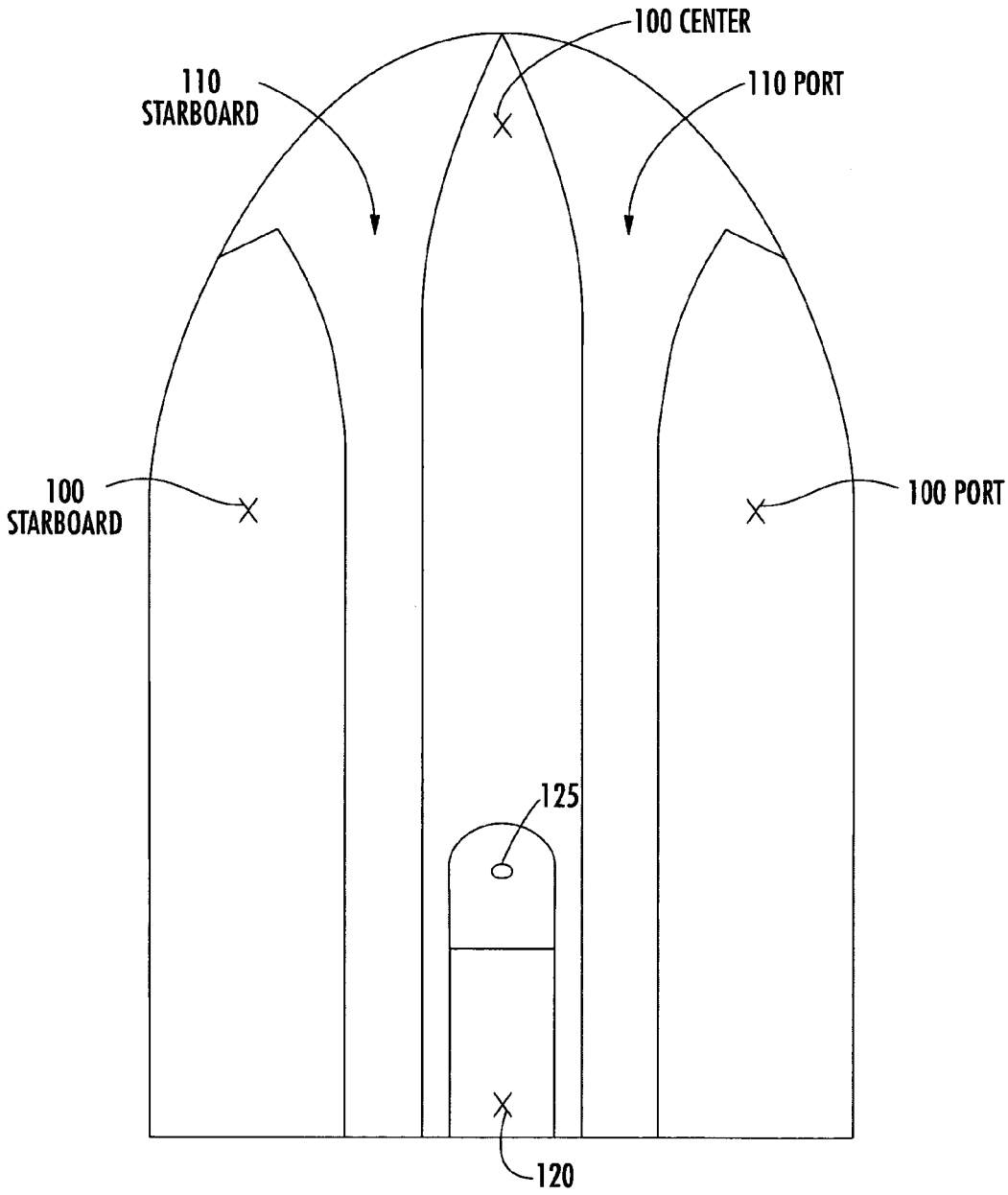
FIG. 1 is a bottom view of the hull of a boat in accordance with one aspect of the invention.

FIG. 1 is a bottom view of the hull of a boat in accordance with one aspect of the invention. Items 100-port, 100-starboard and 100-center function analogously to three pontoons that might be found on a trimaran sailboat. Two channels are formed, 110-port and 110-starboard between hull sections 100-port and 100-center and 100-starboard and 100-center. Item 120 is a tunnel that extends only partially through hull section 100 center. Item 125 is an opening through which a drive shaft can pass to turn a propeller that operates within tunnel 120.

Figure 2:
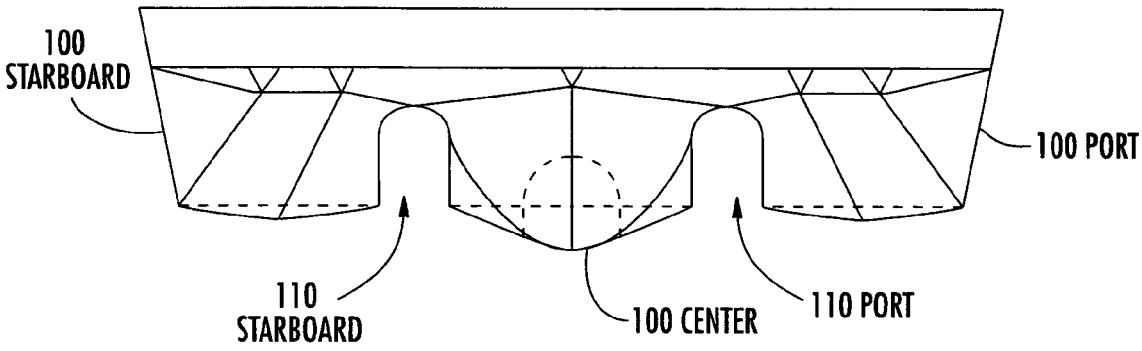
FIG. 2 is a front view of the hull of a boat in accordance with one aspect of the invention.

FIG. 2 is a front view of the hull of a boat in accordance with one aspect of the invention. As shown in FIG. 2, the center portion of the hull 100-center is slightly deeper than the outside portions of the hull, 100-port and 100-starboard. The tunnels formed between the portions of the hull, 110-port and 110-starboard and 100-center are small enough that they fill with water, as more described hereinafter, when the boat is underway.

Figure 3:
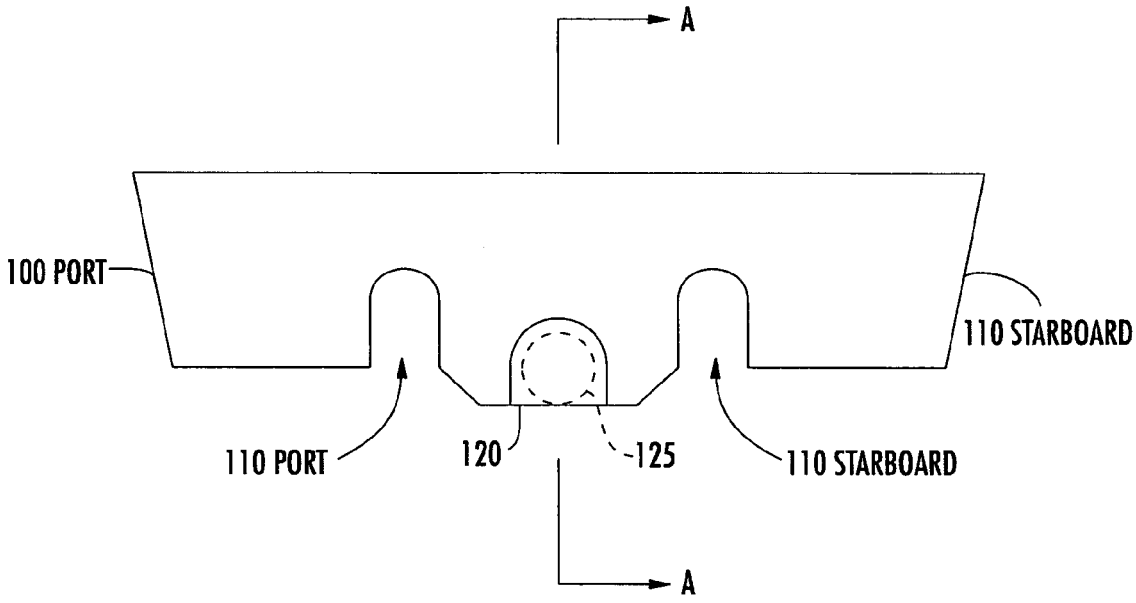
FIG. 3 is a rear view of the hull of a boat in accordance with one aspect of the invention.

FIG. 3 is a rear view of the hull of a boat in accordance with one aspect of the invention. Situated between the two tunnels 110-port and 110-starboard is a third tunnel 120, which extends only partially through the length of the hull section 100-center. The circular path 125 shows the path followed by the external dimension of each blade of a propeller as it drives the boat forward or backward.

Figure 4:
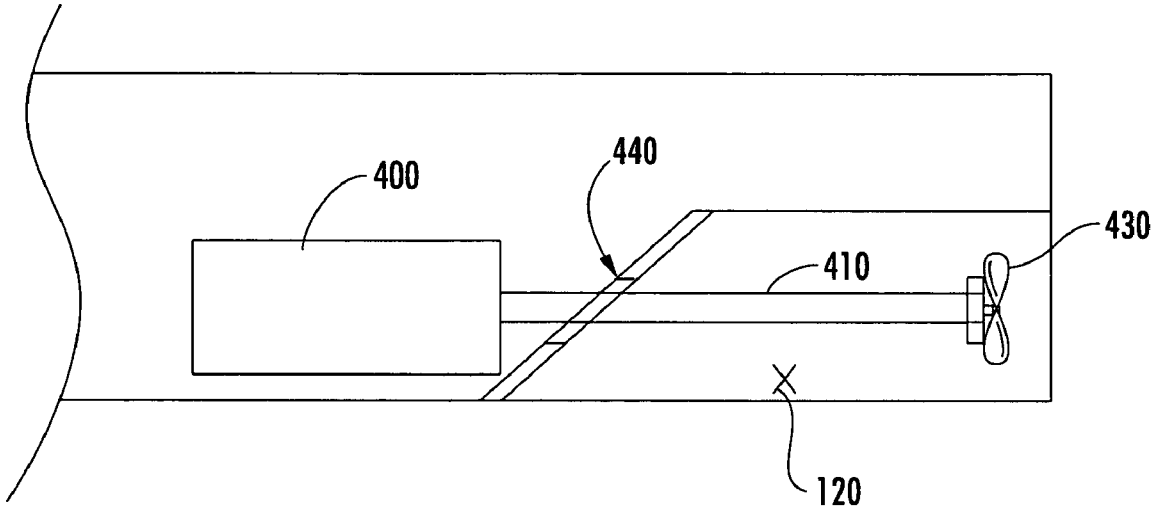
FIG. 4 is a sectional view of one tunnel taken from view A-A in FIG. 3.

FIG. 4 is a sectional view of one tunnel taken from the perspective of section A-A in FIG. 3. FIG. 4 shows a boat engine 400 with a drive shaft 410 connected to a propeller 430 for driving the boat. The propeller and part of the drive shaft extend through opening 440 into the tunnel 120 to enable the propeller to turn and expel water from the tunnel behind the boat, thus causing the boat to move. The boat engine is, of course, mounted firmly to the hull of a boat. In and around passageway 440 are appropriate bearings and seals, which permit the drive shaft 410 to turn without allowing Water from the tunnel 120 to enter into the bilge of the boat.

Figure 5:
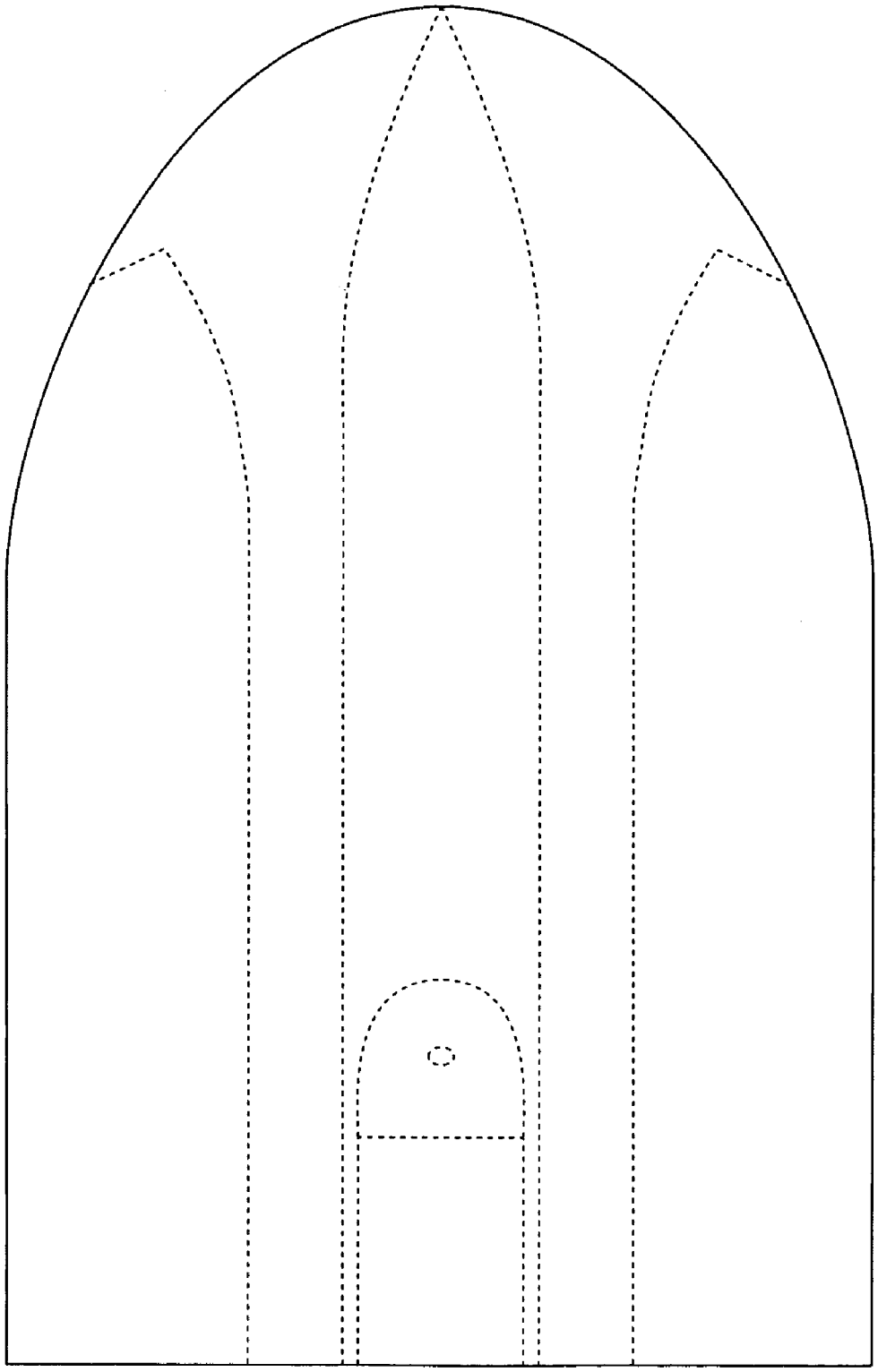
FIG. 5 is a top view of the hull of a boat in accordance with one aspect of the invention.

FIG. 5 is a top view of the hull of a boat in accordance with one aspect of the invention.

The tri-tunnel boat shown in FIGS. 1-5 is designed to run in extremely shallow water. The mechanism that permits this to be achieved is described as follows. The two outside tunnels 100-port and 110-starboard that run the length of the hull are used to mix water and air. As the boat moved forward, water and air pass through those two tunnels causing them to mix with substantial force. The mixing process acts somewhat like carbon dioxide and water in a soda can that has been shaken. It builds up pressure. This pressure in both outside tunnels pushes down and out below the tunnels.

This does three things. First, it creates more drag. This is not desirable but it occurs. The second is that it improves the ground effect lift on the boat and allows it to travel in shallower water. The third is that it causes that water in the vicinity of the two tunnels to attempt to equalize to the same pressure in every area. This causes the water and pressure in the third tunnel to attempt to equalize in pressure with that of the two outside tunnels. This water then fills the tunnel cavity 120 so that the tunnel maintains a degree of fill of water that can be expelled, using the propeller to drive the boat forward. The fact that the drive shaft and propeller are mounted in tunnel 120 as shown in FIG. 4, means that they are protected from obstacles, debris and large mammals, such as manatees. The lift provided by the mixing of air and water during the forward motion of the boat and the lift provided thereby, provides for a very shallow draft boat. The hull shape provides a very stable ride.

The techniques described herein can be applied to a variety of different hull shapes in addition to the specific embodiment described herein within the scope of the invention.

The invention described herein is not limited to the specific examples shown, but rather has a broad applicability to boat construction generally.

What is claimed is:

1. A boat, comprising:

a. a hull having two channels allowing water flow through the two channels substantially from bow to stern, and an intermediate tunnel passing through only a portion less than 50% of the length from bow to stern; and b. a propulsion unit having at least a propeller contained within the intermediate tunnel.

2. The boat of claim 1 in which the hull and the tunnel protect the propeller from obstacles.

3. A boat, comprising:

a. a hull having a tunnel passing through only a portion less than 50% of the length from bow to stern;

b. a propulsion unit having at least a propeller contained within the tunnel; and c. at least one channel near and substantially parallel to the tunnel configured to mix air and water during the forward motion of the boat to create increased water pressure in the tunnel.

4. The boat of claim 3 in which at least one channel is formed on at least one of respective sides of the tunnel and is configured to mix air and water during the forward motion of the boat to create increased water pressure in the channel.

5. The boat of claim 4 in which increased water pressure in the channels increases the water pressure in the tunnel.

6. A method of designing a boat, comprising the steps of:

a. providing for a hull having two channels allowing water flow through the two channels substantially from bow to stern, and an intermediate tunnel passing through only a portion less than 50% of the length from bow to stern; and b. providing for a propulsion unit having at least a propeller contained within the intermediate tunnel.

7. A method of designing a boat, comprising the steps of:

a. providing a hull having a tunnel passing through only a portion of less than 50% the length from bow to stern;

b. providing a propulsion unit having at least a propeller contained within the tunnel; and c. providing at least one channel near and substantially parallel to the tunnel configured to mix air and water during the forward motion of the boat to create increased water pressure in the tunnel.

8. The method of claim 7 in which at least one channel is formed on at least one of respective sides of the tunnel and is configured to mix air and water during the forward motion of the boat to create increased water pressure in the channel.

9. The method of claim 8 in which the channels are configured so that increased water pressure in the channels increases the water pressure in the tunnel.

10. A method of reducing a boats draft, comprising:

a. protecting a propulsion unit by placing a propeller in a tunnel in the hull extending only part way from stern to bow; and b. providing lift by mixing air and water in channels extending through the entire length of the hull.

* * * * *